US005185628A

United States Patent [19]

Wilson et al.

[11] Patent Number: 5,185,628

[45] Date of Patent: Feb. 9, 1993

[54] REPRODUCTION APPARATUS WITH IMPROVED OPERATOR INTERACTIVE DISPLAY FOR USE IN JOB SET-UP

[75] Inventors: James Wilson, Rochester; Douglas B. Beaudet, Brockport, both of N.Y.

[73] Assignee: Easatman Kodak Company, Rochester, N.Y.

[21] Appl. No.: 794,085

[22] Filed: Nov. 18, 1991

[51] Int. Cl.[5] ..... G03G 15/00

[52] U.S. Cl. ..... 355/209; 355/313; 364/188

[58] Field of Search ..... 355/209, 308, 309, 313, 355/314; 364/188; 434/227; 340/711, 712

[56] References Cited

U.S. PATENT DOCUMENTS 5,059,960 10/1991 Rosenberg et al. ..... 340/711

FOREIGN PATENT DOCUMENTS 2-296263 12/1990 Japan ..... 355/313

*Primary Examiner*—Joan H. Pendegrass

*Attorney, Agent, or Firm*—Norman Rushefsky

[57] ABSTRACT

A reproduction apparatus for producing copy, such as copier/duplicator includes an operator control panel that has a display screen for indicating certain standard selectable features for a copying operation including copy format, paper supply source, copy quality, magnification and exit location with plural displayable options for each feature. Buttons are provided for altering the display on the screen to indicate a displayed selected option for each. Improved operator interaction for casual walk-up users is provided by displaying on the display screen, prior to operator selection of a displayed option, the default settings for each of the standard selectable features without simultaneous display on the screen of any additional option associated with each standard selectable feature.

4 Claims, 15 Drawing Sheets

Selected Features
Shows the features that are currently selected.

Features
Press the button required for the feature and the available selections menu will be displayed.

Press the "◇" buttons once to display the selection menu. Press again to scroll until required selection is made.

Features
Once you press the button the available options will be displayed.

REPRODUCTION APPARATUS WITH IMPROVED OPERATOR INTERACTIVE DISPLAY FOR USE IN JOB SET-UP

BACKGROUND OF THE INVENTION

1. Field of the Invention

The invention relates to reproduction apparatus, such as electrostatographic copier/duplicators, and more particularly to such apparatus and displays used therewith for facilitating operator interaction therewith.

2. Brief Description of the Prior Art

In the prior art, reproduction apparatus such as electrostatographic copiers/duplicators are known for producing reproductions of documents. In such apparatus a multisheet document may be reproduced with the option of allowing the operator to select from a multitude of possible copying operations. For example, the reproduction operation may be selected either as a simplex to simplex, simplex to duplex, duplex to duplex or duplex to simplex. Other options can adjust copy quality, magnification, paper supply, type of finishing, accent color, tab operation, chapterization, selective edit, etc.

To accommodate this plethora of options, display screens have necessarily become crowded to convey information as to the many options available and to facilitate the input of even the most complex of jobs.

Thus, in the prior art, reproduction apparatus that are capable of accomplishing complex reproduction jobs were provided with relatively complex operator control panels that appear intimidating to the casual user and affect adversely upon productivity.

SUMMARY OF THE INVENTION

It is therefore an object of the invention to provide a copier/duplicator that provides a simple walkup screen wherein the display of the standard features are reduced to reduce the need to scan and read all the details of the available standard features before starting a job.

It is further an object of the invention to provide a more visually appealing walkup screen to facilitate operator interaction with a relatively complex copier/duplicator.

In accordance with the invention, there is provided a reproduction apparatus for producing copy, said apparatus comprising:

an operator control panel, said panel including means including a display screen for indicating on said screen certain standard selectable features for a copying operation with plural displayable options for each feature, and first means for altering the display on the screen to indicate a displayed selected option for each and generating a first set of signals representing selected options of the standard features;

means for displaying on said display screen, prior to operator selection of a displayed option, the default settings for each of the standard selectable features without simultaneous display on said screen of any additional option associated with each standard selectable feature; and means responsive to said first set of signals for producing copy in accordance with the options selected from the standard features.

BRIEF DESCRIPTION OF THE DRAWINGS

The subsequent description of the preferred embodiments of the present invention refers to the attached drawings wherein.

DETAILED DESCRIPTION OF THE PREFERRED EMBODIMENT

Because electrophotographic reproduction apparatus are well known, the present description will be directed in particular to elements forming part of or cooperating more directly with the present invention. Apparatus not specifically shown or described herein are selectable from those known in the prior art. Particular reference is made to U.S. Pat. No. 4,740,818, and to U.S. application Ser. No. 07/643,878, filed in the name of Wilson et al, the contents of both of which are incorporated herein by this reference.

Figure 1:
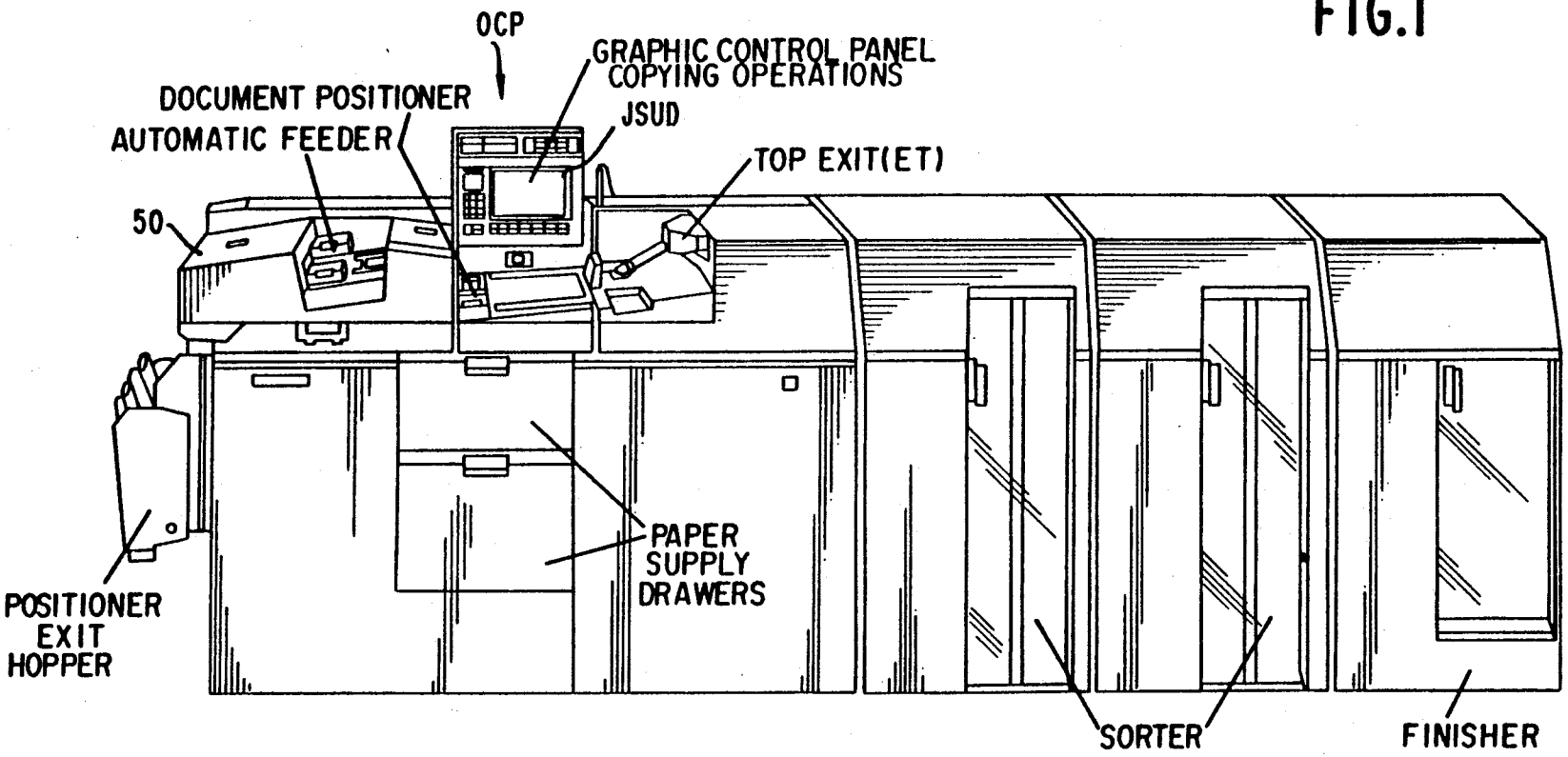
FIG. 1 is a front perspective view of a reproduction apparatus that includes a display screen that is in accordance with the invention.

With reference now to FIG. 1 there is shown an electrophotographic copier/duplicator apparatus 1 having a recirculating document feeder 50 that includes a tray portion for accepting a multisheet document original for reproduction. The apparatus includes an operator control panel, OCP, which as will be described includes buttons and prompting displays for facilitating a job set-up; i.e., the input of an instruction set to the apparatus' logic and control unit (LCU) to enable it to control a series of operations resulting in a desired copy output representing a reproduction of the document originals. Copies may be produced on receiver sheets stored in either or both paper supply drawers holding trays **23*a* and 23*b* (see FIG. 9**). The copy output from the apparatus is stored either in a top exit tray ET or a finisher/sorter. The sorter unit may comprise a series of sorter bins as is well known. For example, the sorter may include two units as shown each including 30 bins which can receive collated and non-collated copies in the order in which they were copied. Each bin say may hold 50 sheets of bond paper. Downstream of the sorter is a finisher that includes a suitable staple mechanism for stapling multisheet document reproductions and delivers them in straight or offset stacks.

Figure 2:
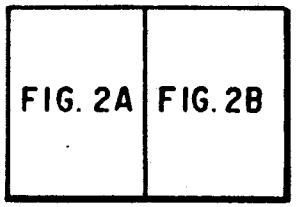
FIG. 2 consisting of FIGS. 2A and 2B is a view of an operator control panel including the display screen with the display on the screen illustrating a standard features walk-up screen as known in the prior art.
Figure 2A:
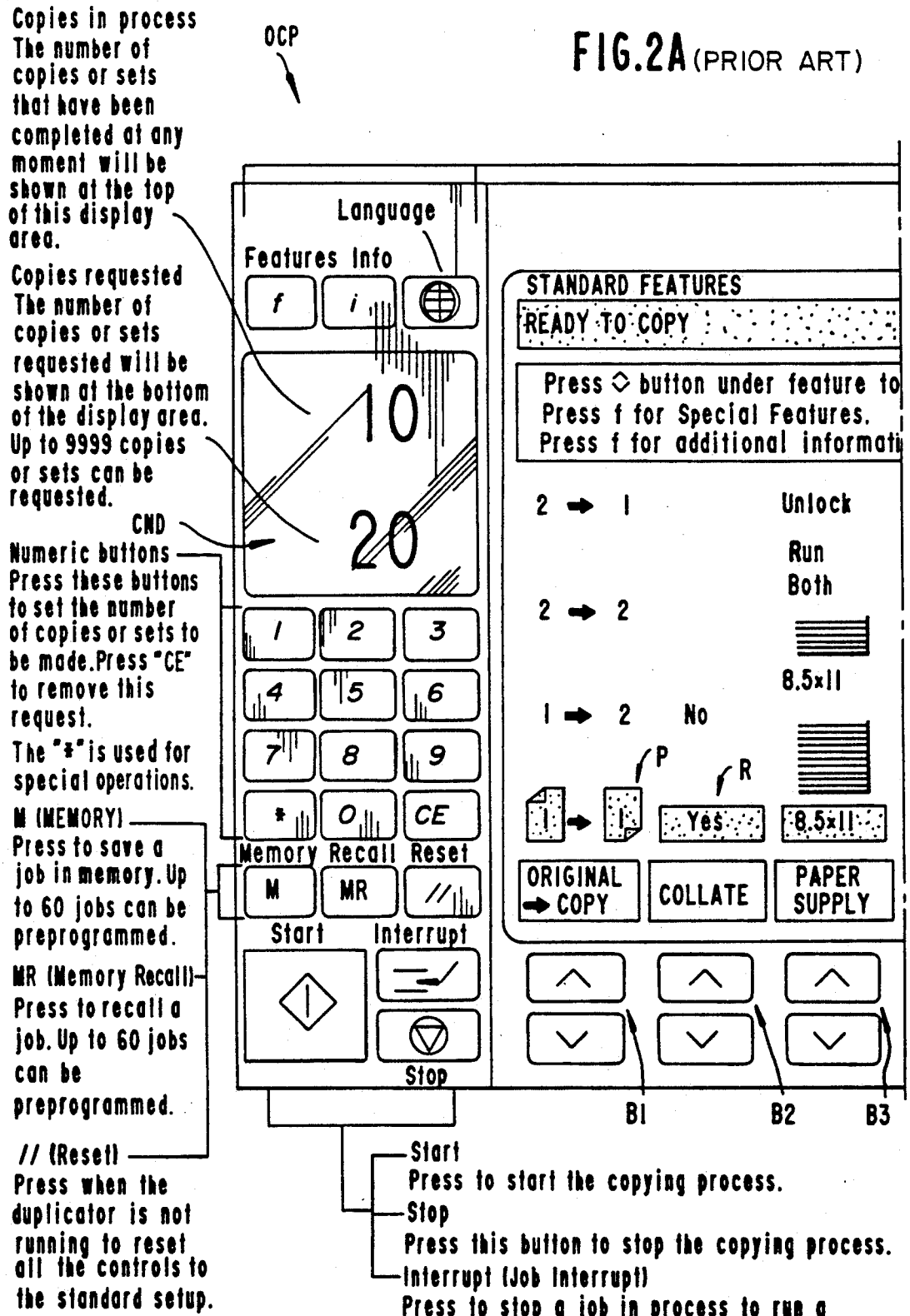
FIG.2A (PRIOR ART)
Figure 2B:
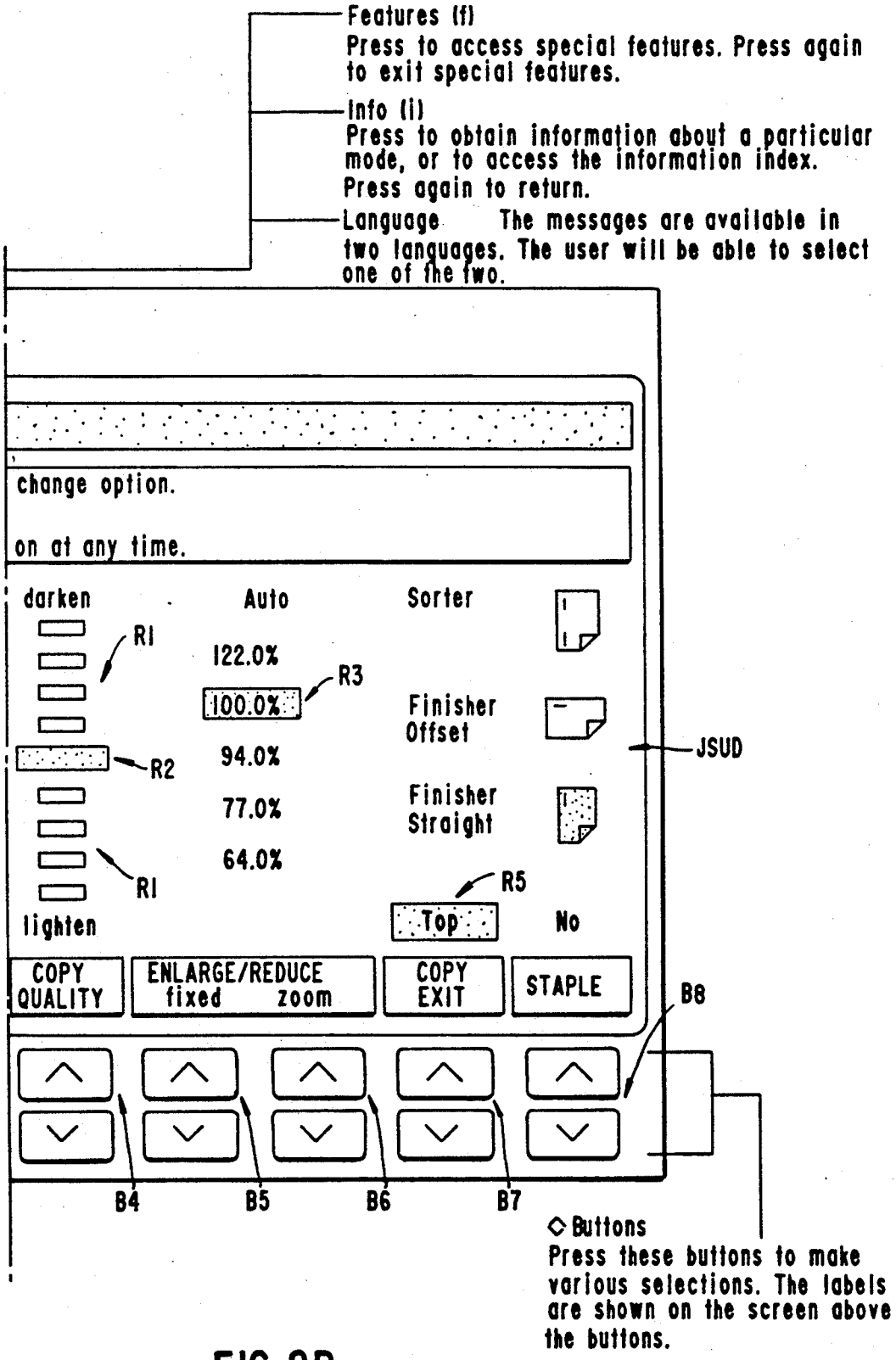
FIG. 2B (PRIOR ART)

With reference now to FIG. 2 there is shown the operator control panel (OCP) which is similar to that illustrated in aforementioned U.S. application Ser. No. 07/643,878, which includes various buttons or keys the functions of which are described in the drawing as well as two display screens including a copies numerical display screen (CND) and a job set-up display screen (JSUD). The screens may be liquid crystal displays, CRT, etc. The numerical display screen as noted in FIG. 2 indicates the number of copies or sets requested as well as the number of copies or sets that have been completed. The job set-up display screen is a known programmable-type screen wherein the copier's logic and control includes a computer program and a bit map memory for controlling the representation that is visible on the display. As noted in the aforementioned application, the display illustrated on the JSUD display screen in FIG. 2 will be referred to as the "standard features display" as it displays various features that a casual user of the apparatus would want when first approaching the apparatus for an average production job. Specifically, there is provided on this display a copy format display that includes a word descriptor "ORIGINAL—COPY" as well as a vertical list or column of numerals above this word descriptor representing from bottom to top a simplex(1) to simplex(1) operation, a simplex(1) to duplex(2) operation, a duplex(2) to duplex(2) operation and a duplex(2) to simplex(1) operation wherein the first word of each operation represents the format of the original document to be copied; i.e., is it a simplex document or a duplex document, and the second word represents what is desired for the copy. As used in the art, the term "simplex" refers to a document sheet having information on one side while "duplex" refers to a document sheet having information on both sides. The OCP includes button set B1 for selecting one of the four available format options. As shown, an operator selection or default selection results in the page-like pictorials P being displayed about the numerals representing the format selected wherein the numerals are now shown in reverse video, i.e., white in a black field. This pictorial display may be scrolled up or down this column by operation of up-down button set B1.

The next portion of the display is defined by a word descriptor "COLLATE" and provides one of two options for selection either "yes" or "no." the operator or default selected option is displayed in reverse video and contained within a displayed rectangle R. In accordance with selection of the available options either collated or noncollated copy sets will be produced. Up-down buttons in button set B2 are used to move the rectangle to either option.

The next portion of the display is defined by a word descriptor "PAPER SUPPLY." This allows identification of the selection of the paper drawer from which copies are reproduced. The selectable options using up-down buttons B3 are lower drawer, upper drawer, run-both sources and unlock, to unlock the selected drawer. A white lettering in black field identifies the selected option. The two paper supply drawers are illustrated with a pictorial representation of a stack of sheets as well as numerical identifiers for the paper size stored in each drawer. The paper size and approximate number of sheets remaining in each drawer are sensed by sensors associated with the trays in each drawer and which provide signals to the apparatus' LCU. The LCU's program control outputs appropriate signals to the bit map memory of the display to display the paper level in each tray. Driver signals from the bit map are fed to the display to illuminate the matrix display in accordance with the signals in bit map memory.

The next portion of the display is defined by the word descriptor "COPY QUALITY" and includes a vertical series of rectangles, R1, all of which are hollow, but for one, R2, which is solidly filled. The words "lighten" and "darken" appear respectively below and above this series to identify that selections to one side of the larger rectangle in the middle of the series progressively request copies to be lightened whereas selections to the other side of this rectangle request progressively darker copies. Up-down button set B4 is used to input signals representing a request to color a desired lighten-darken setting. As with all the up-down buttons, the signals generated by pressing each one represent a request or input to the LCU to change the display by one increment for each depression of the button in the desired direction. The LCU may have a program that allows a depression of a button to scroll from a top most option directly to a bottom most option when the up button is pressed. The down button may be also programmed to scroll directly from the bottom-most option to the top-most option.

The next portion of the display is defined by the word descriptor "ENLARGE/REDUCE" and the remainder of the display relative to this depicts a vertical series of fixed magnification numbers. As used herein the term magnification can refer either to enlargement or reduction depending upon the context. As shown a rectangle R3 surrounds a selected or defaulted to magnification setting in this case 100.0% which represents reproduction of copy at a one to one size relationship. Also in the series of selectable items is an "auto" setting which when selected provides for automatic setting of the taking lens 7 of FIG. 9 to a magnification related to the original document size as sensed using sensors in the feeder and the paper supply selected. Up-down buttons B5 allow the operator to input selections of a desired magnification setting. The selected magnification may also be illustrated in a solid rectangle box R4 (see FIG. 5B) which is also associated with a next portion of the display defined by the word descriptor "zoom." Using up-down buttons B6 the operator may input a desired magnification that is in say 0.5% increments over the entire available magnification range.

The next portion of the display is defined by the word descriptor "COPY EXIT" which serves to define the location of sending of the reproductions. Thus, the available options are indicated for the top exit tray, the finisher tray with sets straight on top of each other, the finisher tray with sets offset from each other, and the sorter. Using up-down buttons B7 a rectangle display will be formed about the selected word location describer now in reverse video such as illustrated within rectangle R5.

The next portion of the display is defined by the word descriptor "staple" which serves to define the type of stapling operation to be performed by the finisher. A vertical series of pictorials illustrate the orientations of possible staple positions for the reproduced copy sets including "NO" which is indicated as being selected by a rectangular box surrounding same and appearing in reverse video. Operator selection of staple position is provided using up-down buttons B8 to alter the display and select the desired option.

It should be noted that the LCU, as in other known copiers, has a program allowing a so-called key operator to control through selected inputs by such operator various default settings for the various selectable items featured on the JSUD.

It will be noted that the JSUD display in combination with the CND display provides sufficient display of the standard features to facilitate input of an average copying job to be requested by a casual user of the apparatus. The standard features display includes additional word instructions and information as illustrated including instructions to press a features button "f" for special features. Other buttons associated with the OCP are illustrated and functional descriptions thereof provided in FIG. 2.

In accordance further with the prior application Ser. No. 07/643,878, upon pressing of the features button "f" a screen display is called up on the JSUD display from the stored program in the LCU. The JSUD display now includes a vertical arrangement of word descriptions of selectable special features that are available on a job level basis. The aforementioned prior application includes description of operator interaction with the display for also programming a copy operation of a multisheet document on a page level basis.

A problem with the display of FIG. 2 is that in displaying all options for selection of the standard features, there is a tendency for casual users of the machine to review the screen in its entirety before operating the machine for a copy job. Since the default selections made by the key operator reflect the most frequent selection of copying jobs by casual walkup users of the machine considerable productivity can be lost particularly when no changes are made by many users from the default settings.

Figure 3:
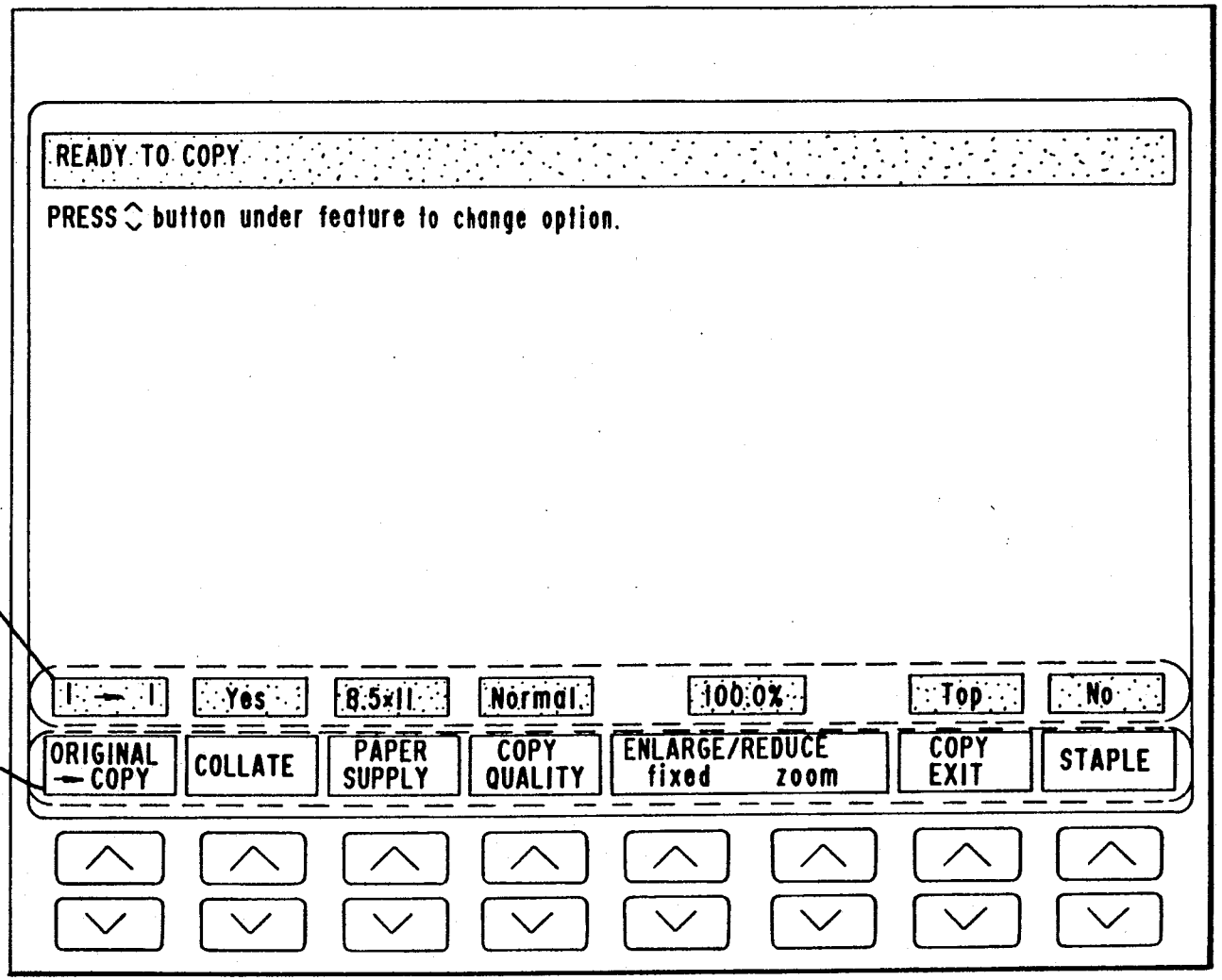
FIG. 3 is a view of the improved display screen of the invention with the display on the screen providing a visually appealing walkup screen identifying the standard features for which the machine is ready to commence a copy operation.

To increase productivity of the apparatus, we propose that the key operator be provided with an option to provide either a full display of standard options to a walkup screen as shown in FIG. 2 or a screen wherein the standard features with indication of defaulted options only (FIG. 3) are provided on the walkup display screen. With the screen of FIG. 3 as the walkup screen, little excess information is displayed to the walkup user and for many users the appropriate job is completed satisfactorily using these default settings. Thus, as shown in FIG. 3, the job set-up display screen, JSUD for walkup indicates that the machine is "ready to copy" and that various options are available and changeable by pressing the scrolling keys, $B_1$–$B_8$ either for up or down scrolling of a selected option. The defaulted options are illustrated in the reverse video format for this machine of white in a black field which designates a selected option. As may be seen in FIG. 4, the walk-up user may desire to view and select other options than those provided by the default only display screen of FIG. 3. Thus, the options available for copy format are called up by pressing either of the buttons B1. By doing this, the operator is indicating an interest in viewing the options for this category for possible change from the defaulted simplex-to-simplex copy operation to which the machine is presently set. The operator may then press either one of the up or down buttons, B1, to scroll through the options to select a different option in the copy format category. As the operator scrolls through the options, the display of FIG. 4 changes with a white numeral in a black field with a page icon identifying a change to a new selected option.

Figure 4:
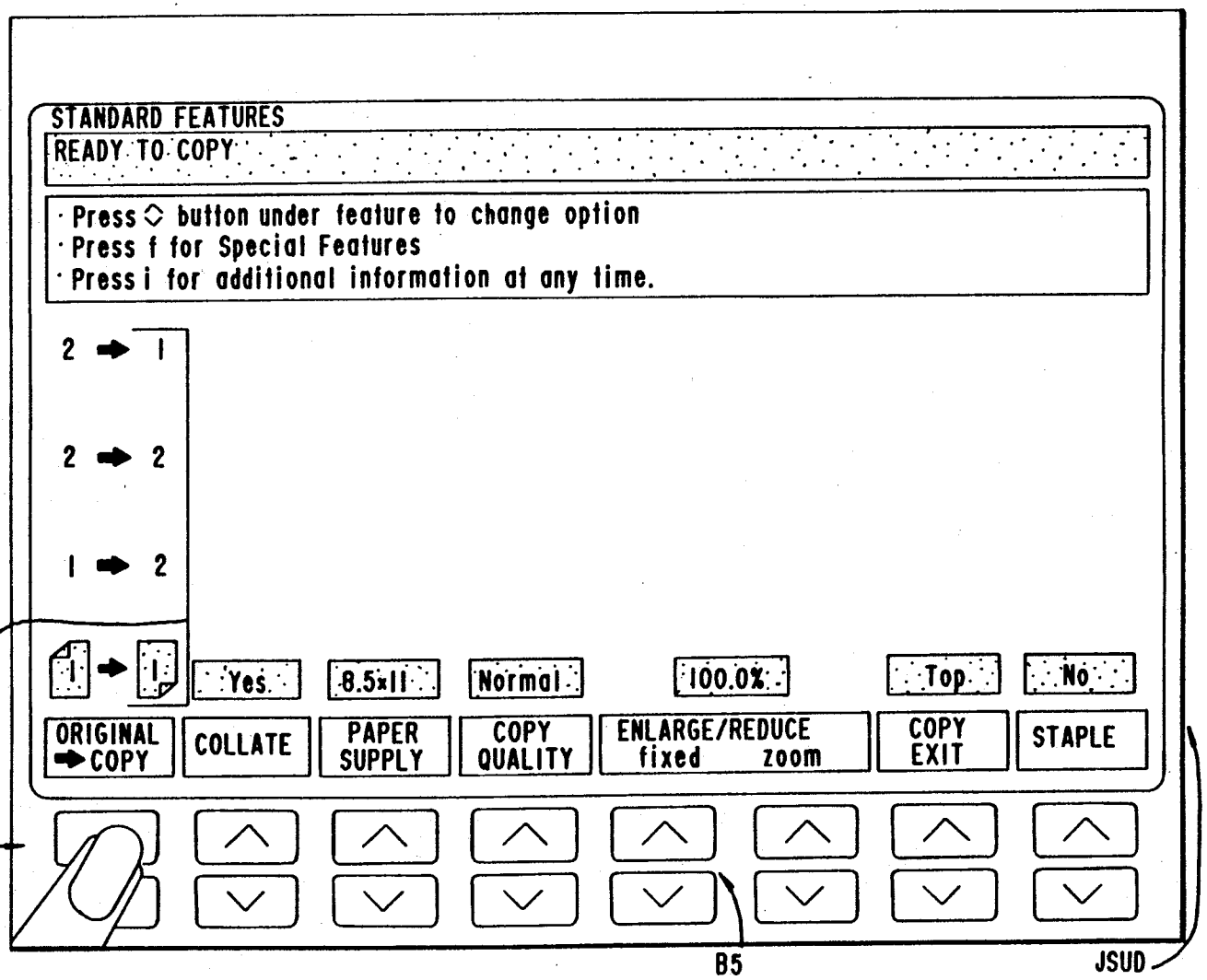
FIG. 4 is a view of the display screen with the display on the screen illustrating options for one of the standard features for which an operator wishes to view available options.
Figure 5:
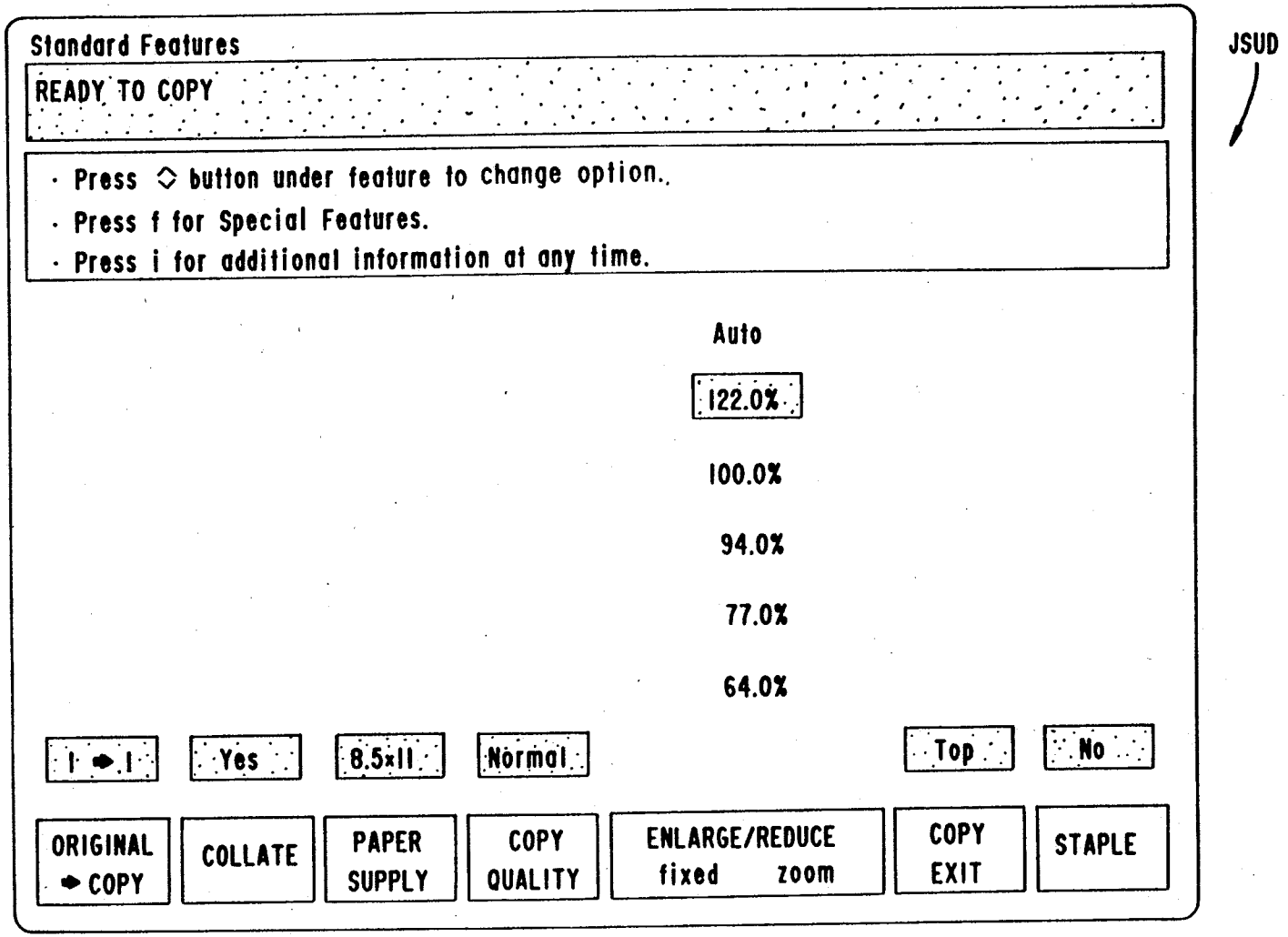
FIG. 5 illustrates operation of the display screens of the invention in conjunction with selection of an optional fixed magnification factor for a copying job.

As may also be seen in FIG. 4, a defaulted option for enlarge/reduce is 100%. This, of course, means that copies will be made without reduction or enlargement. With reference now to FIG. 5, the JSUD screen display for enlarge/reduce is changed by pressing one of the up/down buttons, B5, to change the defaulted display from the selected 100% to a different selection in this example of 122.0%. It will be also noted that once a selection for a category is made by scrolling in either up or down directions to the desired selection of one of the several preset fixed magnification options, the selected option appears in its location in the column in reverse video with the other non-selected items also appearing but in normal video. Thus, if one were to proceed from the display of FIG. 4 to that of FIG. 5, the options regarding copy format would continue to be displayed if the operator has pressed one of the buttons B1 to view the display of copy format. However, the display of FIG. 5 indicates that no other standard features have been previously viewed by the current walk-up user for this job.

A selection is made within any option by leaving the current item in reverse video without the need to further designate that such option is actually selected. However, an additional selection button may be provided or provision made for simultaneously pressing both up and down buttons to signify a selection of an option in a column. As a further alternative, the calling up of options on another column of the standard features may be used as a signal that the current reverse video illustrated option for a prior column is selected and can be displayed at the bottom of the screen with reverse video and thus the screen can be more simplified where multiple columns of features are being changed by the operator from their default selections. With such an alternative, the other options in the column may be removed from the display when the newly selected option is displayed at the bottom of the screen. It is preferred, however, to continue to illustrate columns for which change from a defaulted selection has been made, while the operator investigates options in another column and this provides a concise indication of which features have been changed by the operator.

In FIG. 5, the option under consideration is illustrated to be 122% enlargement and in response to selection of any lens option the lens moves accordingly to an appropriate position as noted below.

Figure 6A:
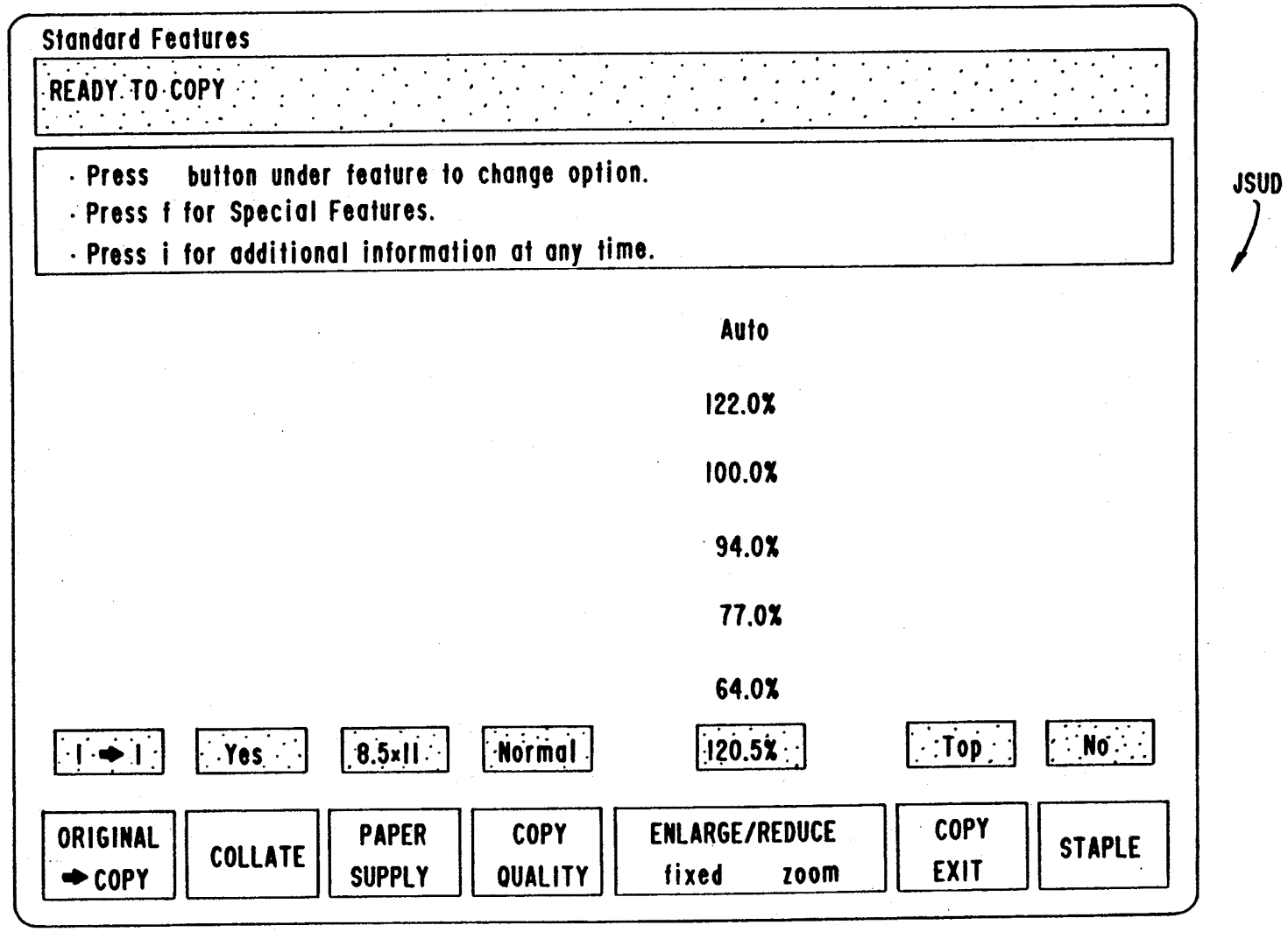
FIGS. 6A, 6B illustrate operation of the display screens of the invention in conjunction with selection of an optional zoom magnification factor for a copying job.

In FIG. 6A, there is shown the pressing of one of the "zoom" buttons B6 (either up or down) to cause the current selected lens setting of 122% set previously as one of the fixed settings as adjusted in FIG. 5 to be changed to a different magnification shown in reverse video at the bottom of the display which is used for display of zoom-default magnifications. Pressing of the down zoom button will cause the display to change in ½% increments to the shown 120.5% of FIG. 6A. The display of a zoom setting is always at the lower level of the display unless it represents a default setting. When the fixed settings are displayed and a zoom button is being pressed, upon reaching a magnification equal to that of a fixed setting, the fixed setting is displayed in reverse video and the display in the zoom display is removed. Thus, the zoom display does not display a magnification when the current selected magnification is one of the fixed settings.

Figure 6B:
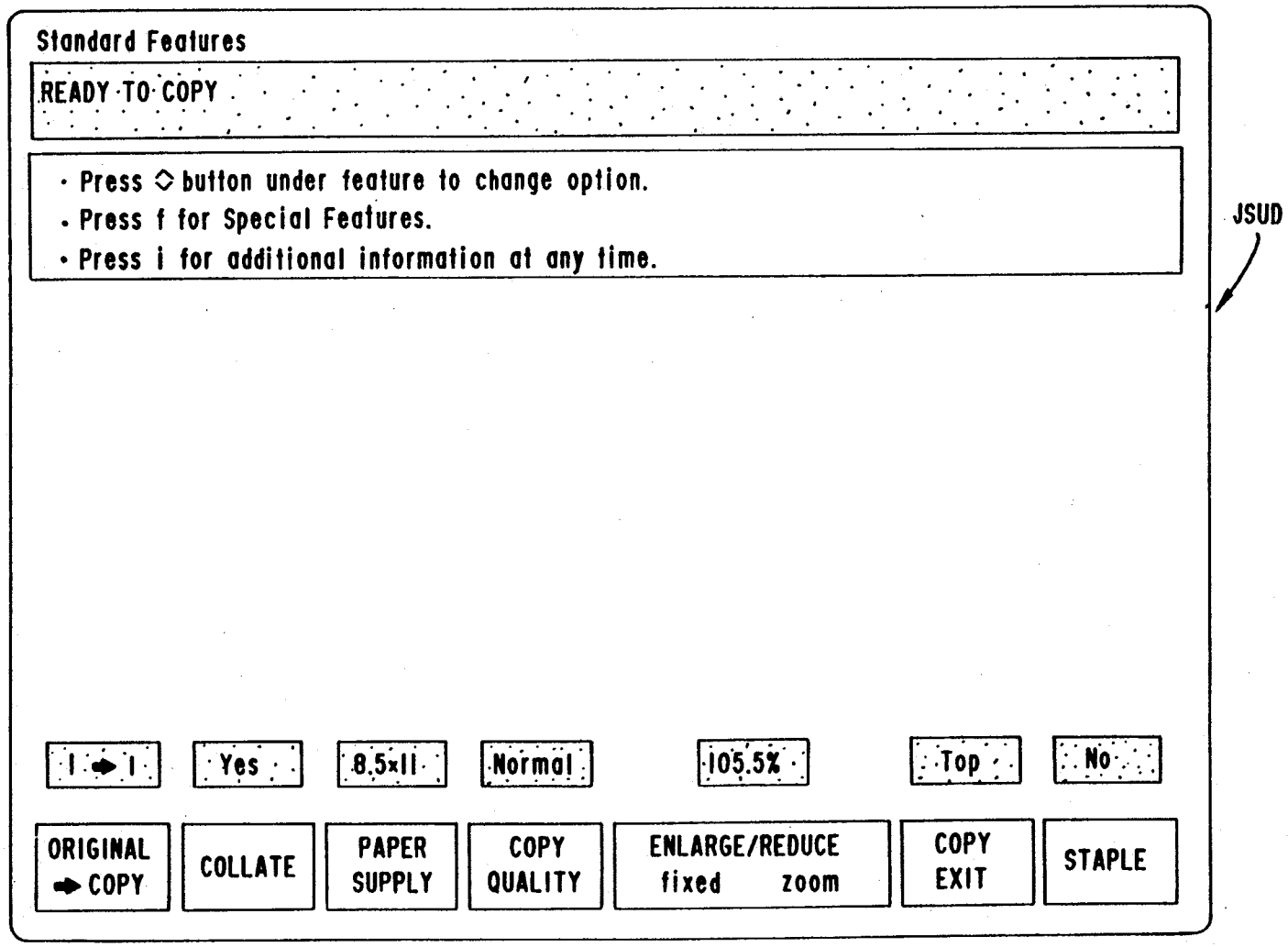

The display in FIG. 6B illustrates the current zoom setting where only the zoom "up and down" buttons have been used and thus without pressing the fixed settings for the lens movement. As will be known to those skilled in the art, the fixed settings represent predetermined magnification settings that have been programmed into the machine so that quick selection of these may be selected without having to step at ½% increments. At times it may be faster to select a fixed setting and then advance to a desired zoom setting by ½% increments from the fixed setting. As used herein, the term "magnification" refers to a change in image size of the copy and contemplates image reduction as well as image magnification.

Figure 7A:
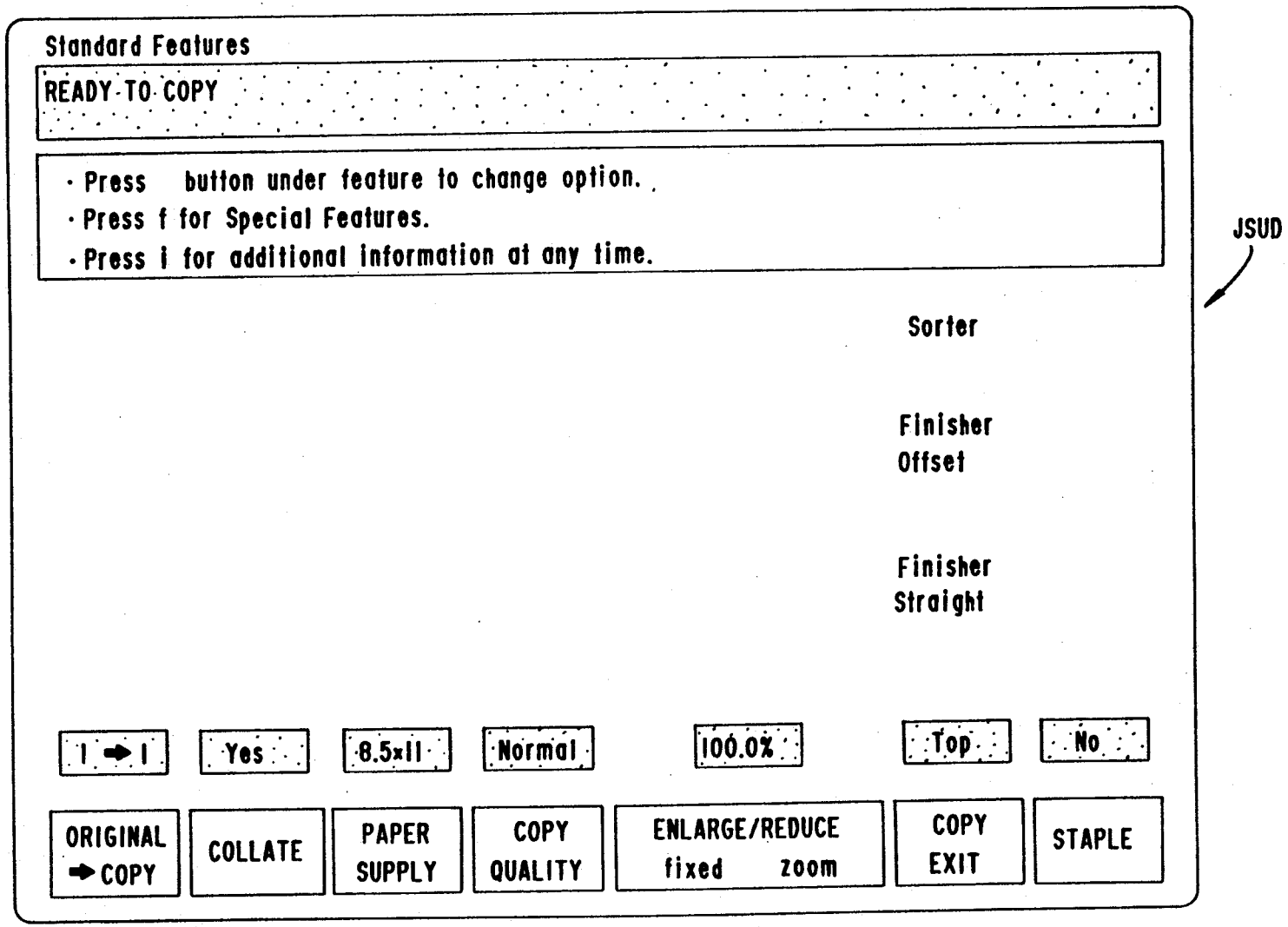
FIGS. 7A and 7B illustrate operation of the display screens of the invention in conjunction with selection of a copy exit for a copying job.
Figure 7B:
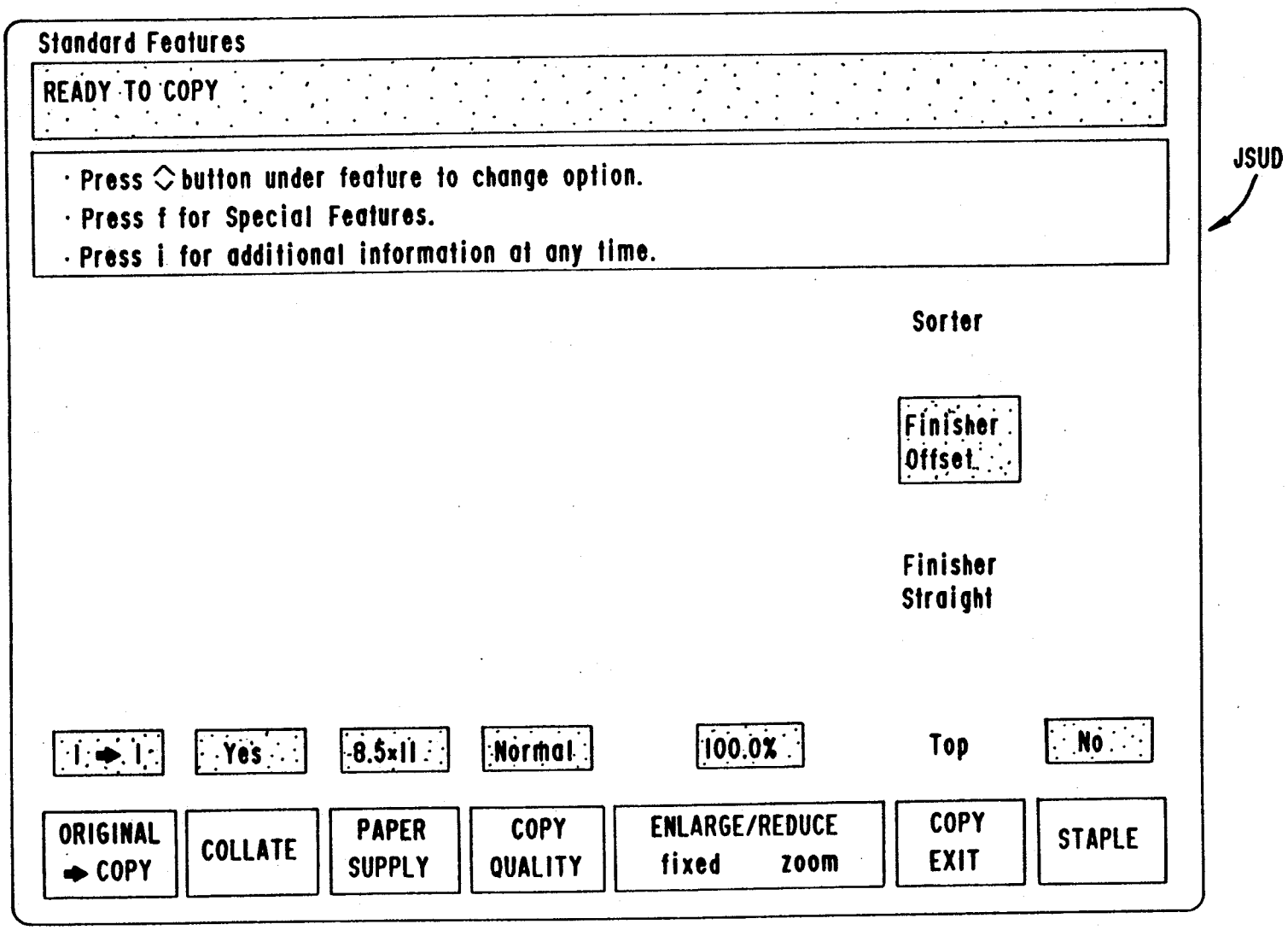

In FIG. 7A, there is illustrated on the display screen the options available for copy exit. This is called up by pressing one of the up/down buttons B7. In FIG. 7B, there is shown the selection of "Finisher-Offset" in reverse video which refers to selection of copies to be sent to the finisher with offset stacking of copy sets. This selection is made by scrolling through the choices by depressing one of the up/down buttons B7 beneath the video display "copy exit".

Figure 8A:
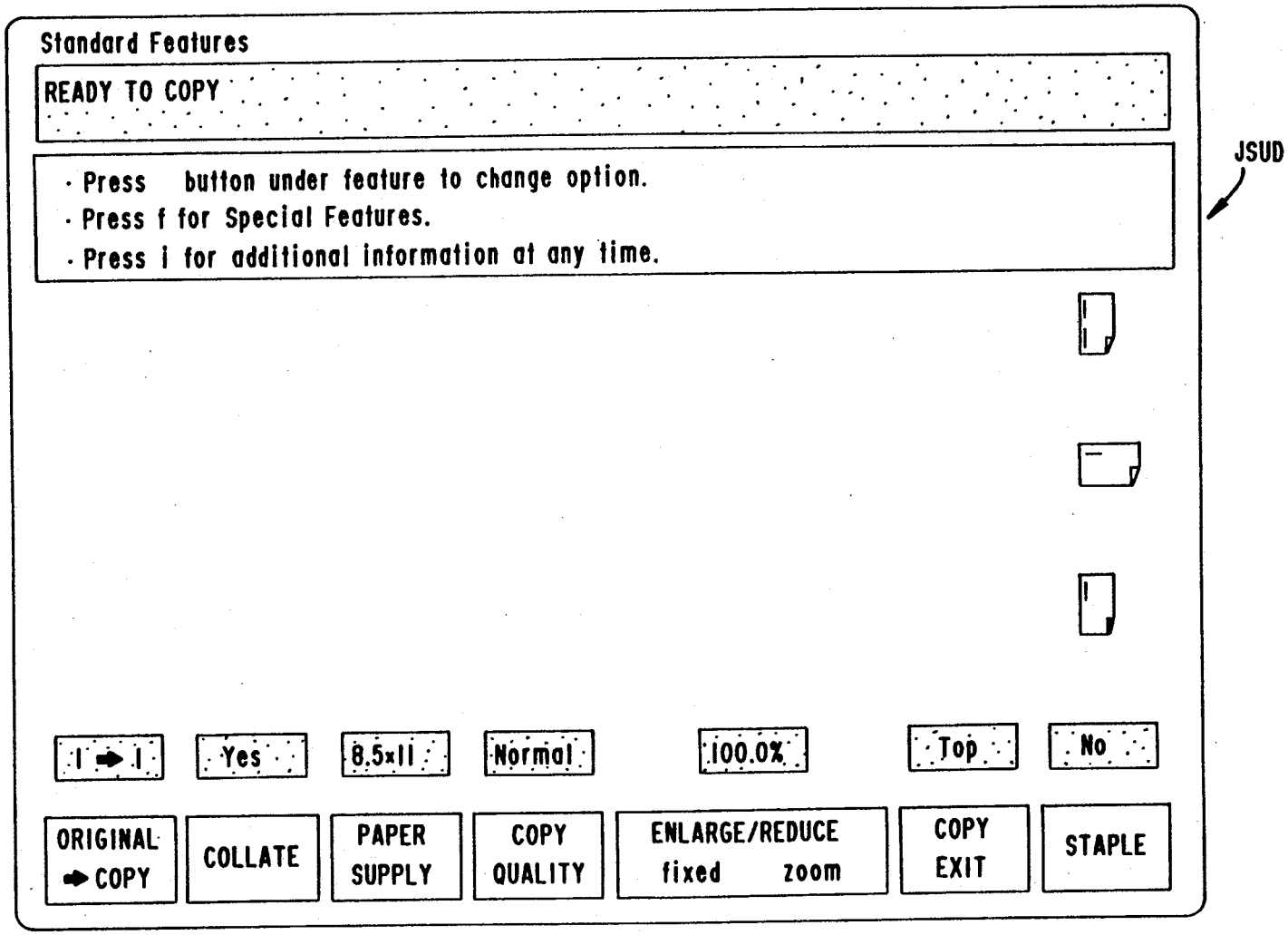
FIGS. 8A and 8B illustrate operation of the display screens of the invention in conjunction with selection of a staple operation for a copying job.

In FIG. 8A, there is shown the various options for stapling of copy sets which can be either the default of no staples or one of the other illustrated icon representations that illustrate staple(s) location vis-a-vis copy sheet orientation. This option column is called up by an initial depressing of one of the up/down buttons B8 beneath "STAPLE".

Figure 8B:
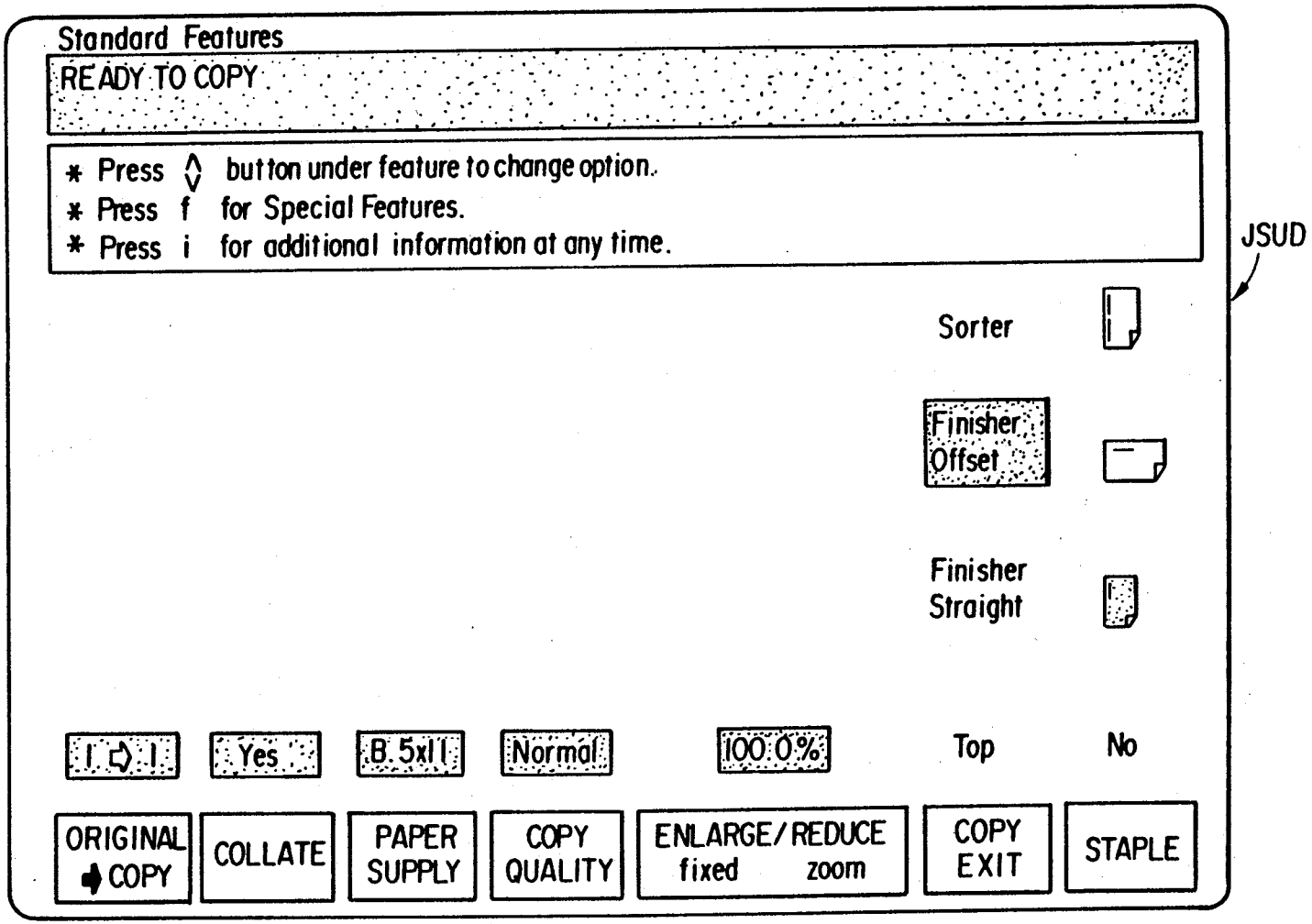

In FIG. 8B, the display screen shows a current selection of "Finisher-Offset" and stapling of copy sets in the upper left hand corner of portrait-oriented copy sheets. To obtain this mode, the operator has scrolled through the copy exit selections as discussed with regard to FIG. 7B and then has scrolled through the "STAPLE" options as discussed for FIG. 7A. There can be a convenience in viewing simultaneously the options available in both of these columns because they both relate to the finishing operation. As the default is set usually to top exit in this machine, with no staple capability for copies exiting at the top exit or sorter, it may be helpful to an operator to see the copy exit options while selecting a staple option. Indeed, when selecting a staple option, the LCU is programmed to simultaneously signal the display to show selection of a default finisher option to be used whenever staples are selected. Thus, a selection of staples either as a default or as a selected option will cause an automatic selection of the finisher option that has been selected for default.

Figure 9:
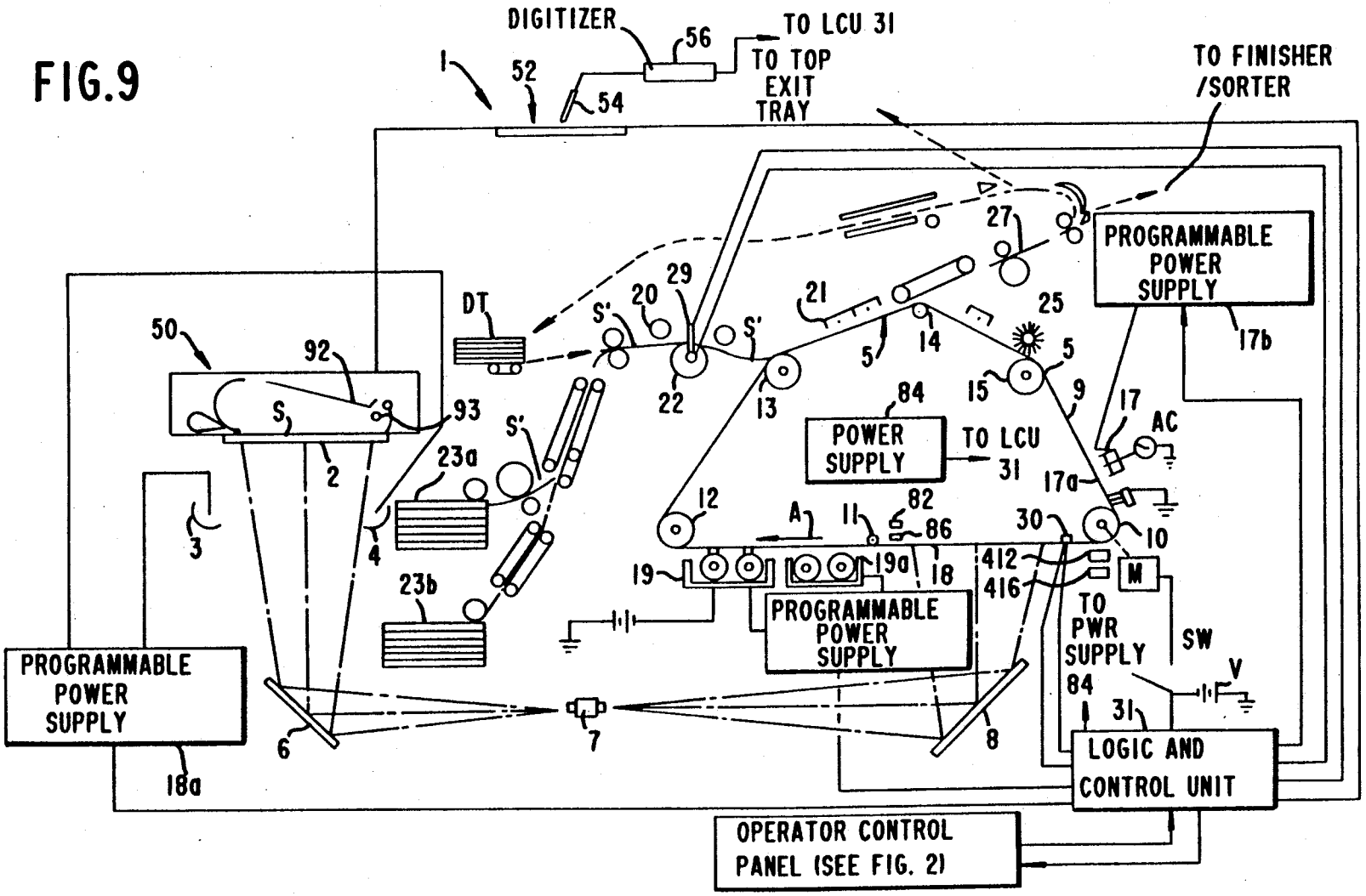
FIG. 9 is a schematic of an electrophotographic reproduction apparatus for making copy in accordance with inputs provided using the screen displays and FIGS. 10A and 10B provide an outline or flowchart of the steps involved in operator interaction with the walk-up display screen.
Figure 10A:
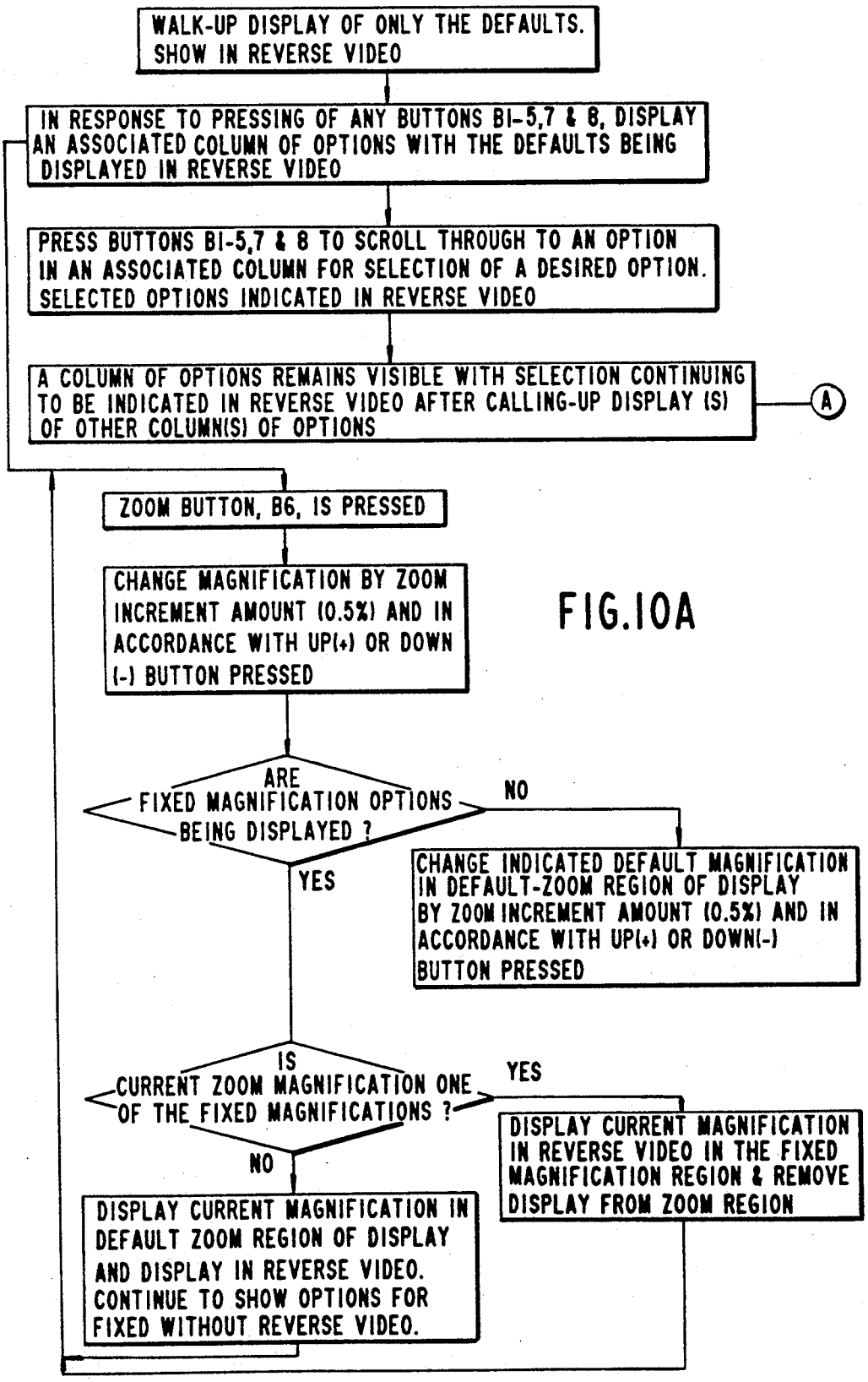
Figure 10B:
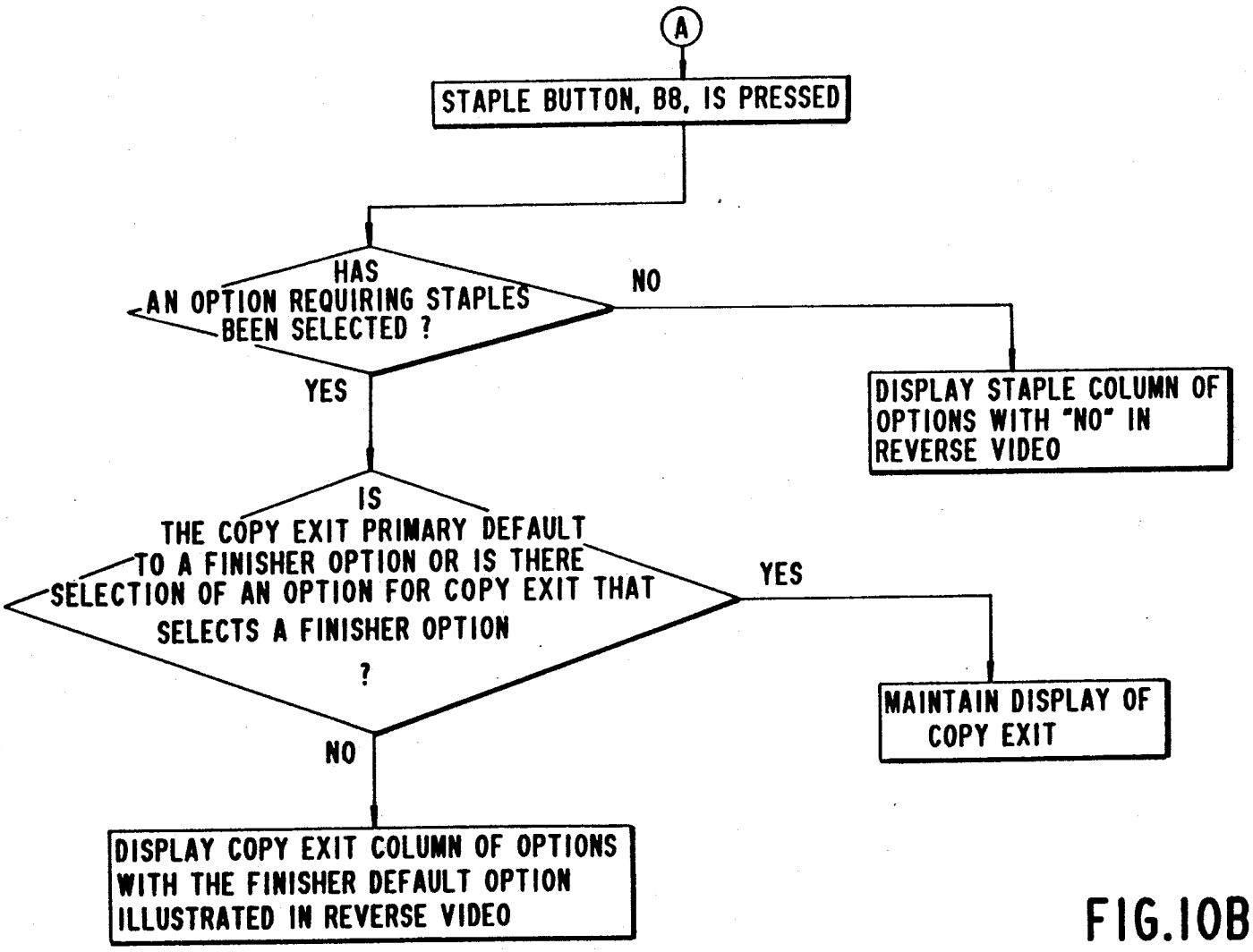

In FIG. 9, there is shown a schematic of the copier/duplicator apparatus for producing copy from multisheet document original placed in a recirculating document handler 50 or an automatic document positioner. As disclosed in the aforementioned U.S. application Ser. No. 07/643,878 more complex jobs may be programmed for reproducing copy, however, this invention is not concerned with same but instead with production of copy using the standard features which represent most of the walkup jobs requested by casual users of the machine. A copying operation may be begun using the standard features by pressing the "start" button and all copies will be reproduced using the selected copy features or default features. The apparatus of FIG. 9 with numeral designators is substantially similar to that of FIG. 2 of the incorporated-by-reference U.S. application Ser. No. 07/643,878 and U.S. Pat. No. 4,740,818 except that with regard to the latter reference, the apparatus of FIG. 9 includes an additional development station 19*a*, two paper supplies 23*a*, 23*b* a duplex tray DT and associated means for feeding copy sheets from the respective trays in accordance with well known principles. Additionally, a digitizer is illustrated in FIG. 9 for use in making edited copy as is known in the prior art. Thus, the paper supply trays 23*a*, 23*b* may be alternatively selected in response to signals from the LCU to feed appropriate type sheets stored therein and requested in accordance with a particular job setup. The duplex tray as is well known receives fused intermediate copies that are to receive an image on a second side by feeding same a second time to the toned image recording photoconductive surface 9 of web 5 with the opposite surface of the sheet in transfer engagement with the surface 9. Briefly, a photoconductive web 5 has a surface 9 charged to a suitable controlled potential $V_0$ by charger 17 and is then exposed to illumination of a document using energized exposure lamps 3,4. The level of exposure $E_0$ and charge $Y_0$ are controlled in accordance with the density contrast settings provided by the copy quality setup. This control of exposure may be regulated by signals from the LCU controlling the voltage or current to the lamp exposure time, or by adjustment of an exposure aperture. Further controls over density may include changes to potential $V_0$ and developer bias as is known in the art. Generally speaking, the illumination level is lower for higher levels towards the darken setting. The recirculating feeder 50 feeds the documents to be copied seriatim to the transparent exposure platen 2 and the exposure of each document original is timed in accordance with the movement of the web 5 as sensed by sensors or encoders 30 providing signals to the LCU 31. The exposure magnification or reduction, and generally referred to as magnification, is in accordance with the position of lens 7 which responds to signals generated from the LCU in response to either the default setting or one of the magnification optional selections. Exposures may be also made using an electronic exposure source such as an LED bar 416 and gradient index lens array 412 in accordance with signals provided from the LCU. After exposure of an image frame, the latent electrostatic image formed may be developed with toner at one of the magnetic brush development stations 19, 19*a*, one of which have black toner and the other, say, a blue colored toner. The image is then transferred to a copy sheet S' fed from either tray 23*a*, 23*b* or the duplex tray DT and fused at fuser station 27 in accordance with signals from the LCU generated in response to a selection of copy format or its default option. Subsequently, the copy sheet is now fed to either the top exit tray or the finisher or sorter in accordance with well known techniques and apparatus and in accordance with a signal from the LCU relative to copy exit. The finisher/sorter operates in accordance with known techniques for collecting the copy sets in accordance with signals provided by the LCU based on inputs provided via interaction with the display screen JSUD as well as operates the stapling mechanisms if such is requested by job set-up or via default operation.

Where selection of a copy format is for duplex operation the LCU will generate signals for directing a copy sheet having a reproduction formed on one side of a copy sheet to be fused and then sent to the duplex tray from which, as is conventional, the copy sheet subsequently is fed into engagement with the surface 9 for receipt of a second image on a second side of the copy sheet. Other portions of FIG. 9 not specifically mentioned herein are described in the aforementioned incorporated-by-reference U.S. Pat. No. 4,740,818. Thus, all reproductions are made using the selected or defaulted standard features in accordance with the descriptions provided above. The defaulted options are input by the key operator say by using a * plus numerical code to call up a program suited for setting up default selections from those options that are available selections.

There has thus been described a copier/duplicator apparatus that includes a job set-up display that reduces the time for setup of a copy job by most casual users and appears even more user friendly to those approaching the apparatus for an average reproduction operation. For a more complex operation, job set-up is provided in layered fashion, i.e., standard features display to job level display to page level display in a relatively consistent manner as described in the aforementioned U.S. application Ser. No. 07/643,878, job programming.

While the invention has been described with reference to electrophotographic copier/duplicators, the invention is also applicable to printers and other types of reprographic apparatus for producing copy.

The word description identifers such as "ORIGINAL—COPY," "COLLATE," "PAPER SUPPLY" etc. are displayed as part of the JSUD display and may change as different levels of features are called up as described in the aforementioned application. In this regard, buttons B1–B8 are considered softkeys since their functions change as different levels of features are displayed on the screen. Touchscreens are also contemplated by our invention.

The invention has been described in detail with particular reference to a preferred embodiment thereof, but it will be understood that variations and modifications can be effected within the spirit and scope of the invention as described hereinabove and as defined in the appended claims.

What is claimed is:

1. A reproduction apparatus for producing copy, said apparatus comprising:

an operator control panel, said panel including means including a display screen for indicating on said screen certain standard selectable features for a copying operation with plural displayable options for each feature, and first means for altering the display on the screen to indicate a displayed selected option for each and generating a first set of signals representing selected options of the standard features;

means for displaying on said display screen, prior to operator selection of a displayed option, the default settings for each of the standard selectable features without simultaneous display on said screen of any additional option associated with each standard selectable feature; and means responsive to said first set of signals for producing copy in accordance with the options selected from the standard features.

2. The apparatus of claim 1 and including means for displaying on said display screen plural displayable options for only one standard selectable feature in response to pressing a button associated with said feature when viewing said display screen containing said default settings.

3. A reproduction apparatus for producing copy, said apparatus comprising:

an operator control panel, said panel including means including a display screen for indicating on said screen certain standard selectable features for a copying operation including copy format, paper supply source, magnification and exit location with plural displayable options for each feature, and first means for altering the display on the screen to indicate a displayed selected option for each and generating a first set of signals representing selected options of the standard features;

means for displaying on said display screen, prior to operator selection of a displayed option, the default settings for each of the standard selectable features without simultaneous display on said screen of any additional option associated with each standard selectable feature; and means responsive to said first set of signals for producing copy in accordance with the options selected from the standard features.

4. A reproduction apparatus for producing copy, said apparatus comprising:

an operator control panel, said panel including means including a display screen for indicating on said screen certain standard selectable features for a copying operation including copy format, paper supply source, copy quality, magnification and exit location with plural displayable options for each feature, and first means for altering the display on the screen to indicate a displayed selected option for each and generating a first set of signals representing selected options of the standard features;

means for displaying on said display screen, prior to operator selection of a displayed option, the default settings for each of the standard selectable features without simultaneous display on said screen of any additional option associated with each standard selectable feature; and means responsive to said first set of signals for producing copy in accordance with the options selected from the standard features.

* * * * *